US011851861B2

(12) United States Patent
Wölfler et al.

(10) Patent No.: US 11,851,861 B2
(45) Date of Patent: Dec. 26, 2023

(54) SINK WITH MOVABLE INSERT PLATE AND PASSIVE DISCHARGE DEVICE FOR RESIDUAL MEDIA ON THE INSERT PLATE

(71) Applicant: BSH Hausgeräte GmbH, Munich (DE)

(72) Inventors: Andreas Wölfler, Saalfelden (AT); Benjamin Reu, Prien am Chiemsee (DE); Ingo Abels, Siegsdorf (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/776,680

(22) PCT Filed: Nov. 11, 2020

(86) PCT No.: PCT/EP2020/081739
§ 371 (c)(1),
(2) Date: May 13, 2022

(87) PCT Pub. No.: WO2021/104873
PCT Pub. Date: Jun. 3, 2021

(65) Prior Publication Data

US 2022/0396941 A1 Dec. 15, 2022

(30) Foreign Application Priority Data

Nov. 29, 2019 (DE) ..... 102019218643.2

(51) Int. Cl.
*E03C 1/186* (2019.01)

(52) U.S. Cl.
CPC ..... *E03C 1/186* (2013.01)

(58) Field of Classification Search
CPC ..... E03C 1/186; E03C 1/181; A47J 47/20; A47L 17/02; A47L 19/02
See application file for complete search history.

(56) References Cited

U.S. PATENT DOCUMENTS 442,626 A * 12/1890 Keane ..... A47L 17/02 4/286
3,346,886 A * 10/1967 Kashiwamura ..... E03C 1/186 108/134
3,882,553 A 5/1975 Poiencot
5,704,492 A * 1/1998 Bartko ..... A47J 47/20 211/41.3

(Continued)

FOREIGN PATENT DOCUMENTS

CN 205577043 U 9/2016
CN 106579805 A 4/2017

(Continued)

OTHER PUBLICATIONS

CN 109695275 machine translation. Espacenet. (Year: 2023).*

(Continued)

*Primary Examiner* — Erin Deery
(74) *Attorney, Agent, or Firm* — Michael E. Tschupp; Andre Pallapies; Brandon G. Braun

(57) ABSTRACT

A sink includes a basin including a base wall and lateral walls adjoining the base wall. The basin includes a receiving area delimited by the base wall and the lateral walls. An insert plate separate from the basin is inserted into the receiving area and moved by a lifting device relative to the basin. A residual media discharge device discharges residual media from a top of the insert plate.

20 Claims, 2 Drawing Sheets

(56) References Cited

U.S. PATENT DOCUMENTS

| | | | | |
|---|---|---|---|---|
| 2003/0146144 | A1* | 8/2003 | Votel | B01D 29/27 210/348 |
| 2005/0067747 | A1 | 3/2005 | Erickson | |
| 2013/0283521 | A1* | 10/2013 | Jain | E03C 1/186 4/654 |

FOREIGN PATENT DOCUMENTS

| | | | | | |
|---|---|---|---|---|---|
| CN | 106724143 | A | * | 5/2017 | |
| CN | 108035411 | A | | 5/2018 | |
| CN | 108316413 | A | | 7/2018 | |
| CN | 109695275 | A | | 4/2019 | |
| DE | 3621151 | A1 | | 1/1988 | |
| DE | 202013006437 | U1 | * | 12/2013 | E03C 1/181 |
| WO | WO-2016051238 | A1 | * | 4/2016 | E03C 1/18 |

OTHER PUBLICATIONS

National Search Report DE 10 2019 218 643.2 dated Aug. 21, 2020.
International Search Report PCT/EP2020/081739 dated Feb. 1, 2021.

* cited by examiner

SINK WITH MOVABLE INSERT PLATE AND PASSIVE DISCHARGE DEVICE FOR RESIDUAL MEDIA ON THE INSERT PLATE

CROSS-REFERENCES TO RELATED APPLICATIONS

This application is the U.S. National Stage of International Application No. PCT/EP2020/081739, filed Nov. 11, 2020, which designated the United States and has been published as International Publication No. WO 2021/104873 A1 and which claims the priority of German Patent Application, Serial No. 10 2019 218 643.2, filed Nov. 29, 2019, pursuant to 35 U.S.C. 119(a)-(d).

The contents of International Application No. PCT/EP2020/081739 and German Patent Application, Serial No. 10 2019 218 643.2 are incorporated herein by reference in their entireties as if fully set forth herein.

FIELD OF THE INVENTION

One aspect of the invention relates to a sink with a basin. The basin has a base wall and lateral walls adjoining the base wall. The basin has a receiving area delimited by the walls. Moreover, the sink has an insert plate which is separate from the basin and which is inserted into the receiving area.

BACKGROUND OF THE INVENTION

Such sinks are known. Thus a sink which has a basin is disclosed, for example, in US 2005/0067747 A1. A base which is configured in one piece with the basin bottom and which extends upwardly is configured on the basin bottom. A plate may be attached to this base. As a result, a cutting board is formed on which objects, such as food, may be chopped. Such an embodiment is disadvantageous in that the integrated base is always present and thus a basic embodiment of the basin is complex in terms of shape and is configured such that the receiving area is restricted over the periphery. Moreover, it is always the case that the plate which is able to be positioned on the base is arranged only at one height level. The plate is only able to be positioned or removed by a user.

A sink is also disclosed in DE 362 1151 A1. Various inserts which may be inserted into the receiving area are provided separately from the basin. The inserts may be plates or further basin-like containers. These inserts may be positioned on the upper edge of the basin. The usability of a sink is also significantly restricted thereby and the inserts have to be attached or removed by a user, and it is always the case that the inserts are able to be positioned only at one individual position.

BRIEF SUMMARY OF THE INVENTION

It is the object of the present invention to provide a sink with a basin and a separate insert plate, in which the insert plate is able to be kept clean.

One aspect of the invention relates to a sink with a basin. The basin has a base wall and lateral walls adjoining the base wall. The basin also has a receiving area delimited by the base wall and the lateral walls. The receiving area is open at the top. The sink has an insert unit, in particular an insert plate, in particular a contiguous and non-perforated insert plate, which is separate from the basin. This insert plate is able to be inserted into the receiving area or is inserted therein. The sink also has a lifting device, by means of which the insert plate can be moved relative to the basin in the height direction of the sink. This is made possible by a physical lifting device of the sink. Thus a sink is provided in which in principle the possibility is provided to arrange the insert unit at different vertical positions. This is also made possible by a lifting device and does not have to be carried out manually by the user himself. In principle, it is possible that a continuous vertical adjustment of the insert plate is made possible by the lifting device. Thus it is possible to approach and set many different height levels of the insert plate.

It is preferably provided that a residual media discharge device is configured at least in the top of the insert plate and has a through-hole passing through the insert plate.

Additionally or alternatively, it may be provided that the residual media discharge device has at least one drainage channel in the top of the insert plate which is oriented toward the edge of the insert plate. When viewed over its entire length, this drainage channel may be configured toward the top. The drainage channel, however, may also be configured as a drainage duct. In such an embodiment, only one duct inlet is open toward the top of the insert plate and thus over the remaining length of the drainage channel this duct is closed toward the top of the insert plate. The duct may be guided with a channel outlet toward the edge of the insert plate. Additionally or alternatively, this drainage channel may be guided with a channel outlet to the lower face of the insert plate. This may also be configured spaced apart from the edge. A specific exemplary embodiment of a passive residual media discharge device is formed by means of such an embodiment.

A passive residual media discharge device is to be understood to mean such a residual media discharge device which does not also require a physical component in addition to the insert plate in order to permit the discharge of residual media on the insert plate. A passive residual media discharge device is also to be understood to mean such a residual media discharge device which is configured virtually statically on the insert plate itself, in particular is integrated therein. The passive residual media discharge device is configured to be unchangeable in terms of position and size. In particular, the drainage channel may be configured to be inclined relative to the horizontal, in particular inclined downwardly, when viewed from the channel inlet thereof to the channel outlet. The automatic discharge of liquid residual media, which thus remain standing or are deposited on the top of the insert plate, may be carried out in a particularly advantageous manner thereby.

In a further embodiment it may be provided that the residual media discharge device is or has a bowed top of the insert plate. The bowed shape may be such that the insert plate has a slight funnel shape. A bowed shape, however, may be oriented in the opposing direction. For example, therefore, the top may be slightly deformed in a dome-like and thus convex manner.

A static residual media discharge device is configured as a passive residual media discharge device by means of this embodiment. This passive residual media discharge device is also integrated in the insert plate. It is thus also provided in this embodiment that this residual media discharge device remains permanently present and is configured to be unchangeable on the insert plate.

In a further embodiment it may be provided that the residual media discharge device has a hydrophobic coating. This coating may be applied at least in some regions to the top of the insert plate. The discharge of, in particular liquid, residual media is made possible in a particularly advantageous manner thereby. In particular, it is avoided thereby that an undesired puddling of liquid residual media occurs on the top of the insert plate.

It is preferably provided that the residual media discharge device has a drip rim on the edge of the insert plate. For example, this drip rim may be formed as an undercut. A concave or convex curvature of the edge of the insert plate may also be formed in order to configure such a drip rim.

In an advantageous embodiment it is provided that the insert plate has an upper plate and a lower plate which is arranged therebelow. The two plates are separate components which are fixedly connected together. When viewed in a horizontal plane, the lower plate projects to the side beyond the upper plate. By means of such a projection the situation may be provided in which liquid residual media are able to be drawn virtually automatically to this edge or to the projection of the lower plate, in particular due to the surface tension. It may be provided that this horizontal projection of the lower plate is configured in some regions over the periphery or is configured entirely over the periphery on the edge. In particular, it may be provided that the upper plate is guided into the lower plate by an oblique transition. However, a perpendicular marginal edge of the upper plate may be formed. As a result, a stepped transition is formed between the upper plate and the lower plate which projects horizontally to the side relative thereto.

It may be provided that the upper plate is configured as made from metal. In particular, the upper plate may be made from steel. The upper plate may have a coating as a top. In an advantageous embodiment, the lower plate may be configured as made from plastic. In particular, the lower plate may be connected to the upper plate such that it cannot be released in a non-destructive manner.

In particular, a plate receiver for the insert plate is configured on the upper region of the upper lifting segment. For example, this plate receiver may be implemented as an injection-molded component, in particular as a two-component injection-molded component. It may be provided that at least one through-hole is located in this plate receiver. An actuating element may extend through this through-hole from below, a support vane positioned on the plate receiver being able to be lifted thereby. In particular, a pivoting about a horizontal pivot axis may be implemented by this lifting so that a support vane may be positioned obliquely and thus in a tilted manner. Preferably, such a hole or a feedthrough in the plate receiver is covered in the upper region by a resilient component. As a result, it is possible to avoid the situation where media could pass from above into this hole in the insert plate receiver. Since this cover is configured in a resilient manner, the actuating element may act on this resilient element and bulge it upwardly. Thus a corresponding actuating force may also be transmitted to the support vane and this support vane may be tilted.

In an advantageous embodiment it is provided that a top of the insert plate has a surface which is at least 80 percent, in particular at least 90 percent, in particular at least 95 percent, of the surface of the receiving area in a horizontal plane. The surface of the top of the insert plate, however, is less than 99 percent of this surface of the receiving area. By such a dimensioning, the insert plate is configured over virtually the entire surface area relative to the clear width of the receiving area between the lateral walls, and thus fills up this receiving area virtually entirely when viewed in the horizontal plane. On the other hand, however, a small gap, in particular of between 3 mm and 15 mm, in particular of between 3 mm and 10 mm, is permitted over the periphery so that, on the one hand, the relative movement of the insert plate may be carried out unhindered when setting the position or changing the position. In particular, as a result, this avoids direct contact and a side edge of the insert plate potentially scraping along the inner faces of the lateral walls. Thus, on the one hand, damage to the lateral walls is avoided and, on the other hand, damage to the insert plate and also to the lifting device is avoided. Last but not least, it is also advantageously achieved by this embodiment that liquid which is present on the top of the insert plate may be drained in a simple manner into the receiving area through this gap between the edge of the insert plate and the inner faces of the lateral walls.

Preferably, the basin has a drain, in particular on the base wall. As a result, a medium which is arranged in the basin and collects therein may drain out easily via the drain.

In particular, the basin is configured in one piece with the base wall and the lateral walls. In particular, the basin is configured as made from metal.

The base wall may be flat or slightly inclined or slightly bulged. In particular, it is provided that the point of the base wall at which an outlet for a drain of the sink is configured is offset furthest toward the bottom relative to the vertical position.

It may be provided that the top of the plate is configured to be entirely flat. However, the top may also be slightly bulged. It is also possible that the top of the insert plate is structured at least in some regions. As a result, a certain roughness may be generated. As a result, it is possible to avoid in an improved manner undesired slippage of objects positioned thereon. For example, this is advantageous when a change in the position of the insert plate occurs and objects are still arranged on the top of the insert plate. It is also possible that the top has specific positioning regions. These positioning regions may be recesses. However, such recesses may be configured to be relatively small, for example. This is advantageous in order to be able to position, for example, vessels such as a glass or the like more securely. In particular, this is advantageous when a change in the position is tilting and/or rotating. An undesired slippage of such vessels is thus avoided. Moreover, it is also achieved by such predetermined positioning regions, for example, that when vessels are positioned on the top of the insert plate and, for example, are designed to be filled via the faucet, the water running out of the faucet flows accurately into the vessels with a rotational movement and does not run over the circumference of the vessels onto the insert plate.

The positions and orientations provided when the sink is used as intended and arranged as intended are specified by the terms "top", "bottom", "front" "rear" "horizontal", "vertical", "depth direction", "width direction", "height direction".

Further features of the invention emerge from the claims, the figures and the description of the figures. The features and combinations of features mentioned above in the description, as well as the features and combinations of features mentioned below in the description of the figures and/or shown individually in the figures are not only able to be used in the respectively specified combination but also in other combinations or individually without departing from the scope of the invention. Thus embodiments of the invention which are not explicitly shown and described in the figures but which emerge from and which may be generated by separate combinations of features from the described embodiments are also to be regarded as encompassed and disclosed. Embodiments and combinations of features which thus do not have all of the features of an originally formulated independent claim are also to be regarded as disclosed.

BRIEF DESCRIPTION OF THE DRAWINGS

Exemplary embodiments of the invention are described hereinafter in more detail with reference to schematic drawings. In the drawings.

DETAILED DESCRIPTION OF EXEMPLARY EMBODIMENTS OF THE PRESENT INVENTION

Figure 1:
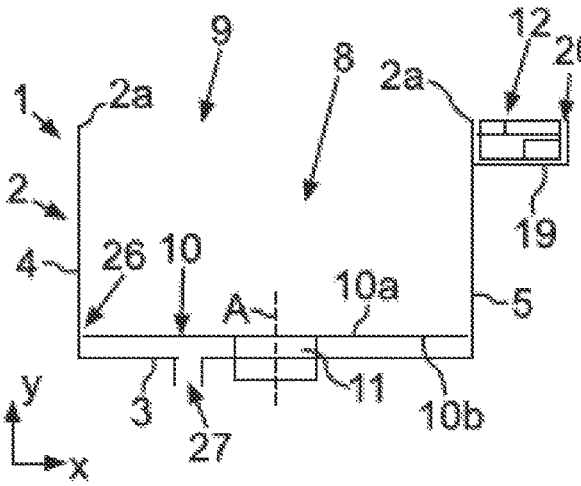
FIG. 1 shows a schematic sectional view through an exemplary embodiment of a sink according to the invention with an insert plate in a first position.

Elements which are the same or functionally the same are provided with the same reference characters in the figures.

Figure 3:
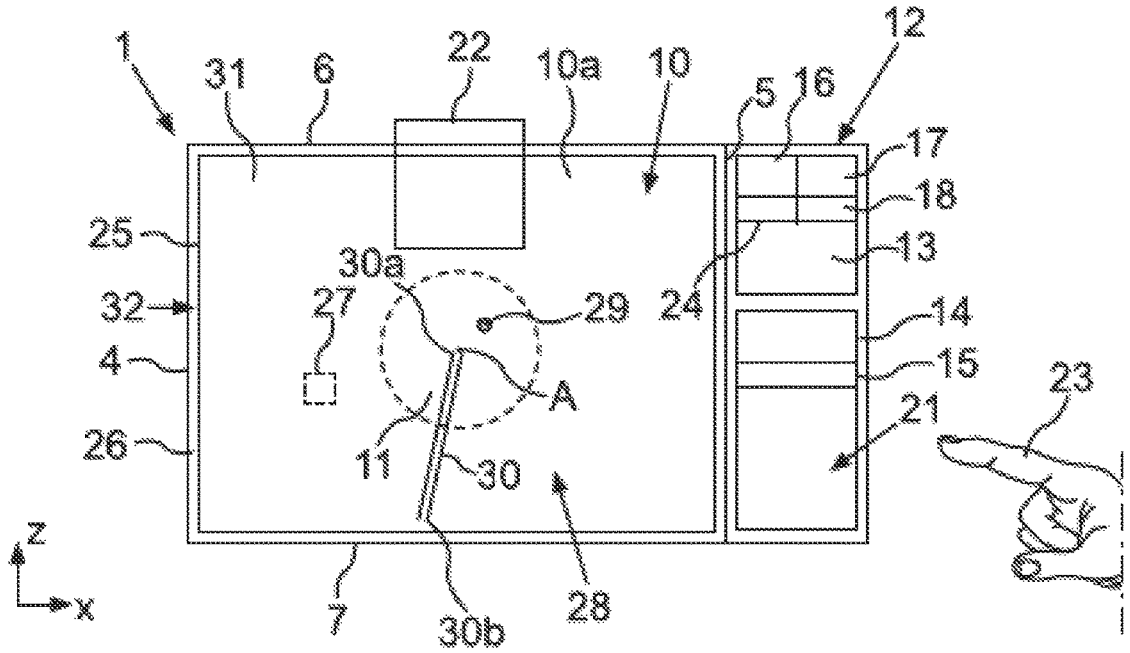
FIG. 3 shows a plan view of an exemplary embodiment of a sink.

A sink 1 is shown in FIG. 1 in a schematic vertical sectional view (x-y plane with the height direction y and width direction x). The sink 1 has a basin 2. The basin 2 has a base wall 3 and adjoining and upwardly extending lateral walls 4, 5, 6 (FIG. 3) and 7 (FIG. 3). The basin 2 is configured, in particular, in one piece. The basin is preferably configured as made from metal. The basin 2 has a receiving area 8. The receiving area 8 is delimited by the aforementioned walls 3 to 7. Thus the basin 2 has an upper loading opening 9. The sink 1 also has an insert unit. The insert unit is, in particular, an insert plate 10. The insert plate 10 is configured, in particular, in one piece. The insert plate 10 is a component of the sink 1 which is separate from the basin 2. The sink 1 also has a lifting device 11. The insert plate 10 is arranged on the lifting device 11. In particular, the insert plate is arranged on the lifting device 11 such that it can be released in a non-destructive manner. The insert plate 10 is movable relative to the basin 2 by way of the lifting device 11. In this context, a movement may take place in the height direction (y-direction) of the sink 1. Additionally or alternatively, a rotation may take place about a vertical axis A of the lifting device 11. Additionally or alternatively, a tilting of the insert plate 10 may take place. This means that the insert plate 10 may be set with its plane at an angle to a horizontal plane. It may thus be positioned in an inclined or oblique manner. In FIG. 1 the insert plate 10 is shown in an exemplary position in the receiving area 8. In particular, this is a position which has been moved downwardly. In this regard, the insert plate 10 is arranged directly adjacent to the base wall 3.

Preferably, the sink 1 has an interaction unit 12. The interaction unit 12 may have a display unit 13 (FIG. 3). The interaction unit 12 may have an operating device 14. The operating device 14 may have one or more operating elements. The operating elements may be push buttons or switches or toggle elements or rotary knobs. The operating device 14, however, may also additionally or alternatively have a touch-sensitive operating panel 15. In an advantageous embodiment it may be provided that the interaction unit 12 has at least one optical detection unit 16. The optical detection unit 16 may be, for example, a camera. The camera may be sensitive in the spectral range visible to humans. The interaction unit 12, however, may also additionally or alternatively have an acoustic unit 17. This acoustic unit 17 may be configured for the reception and/or for the output of speech signals. Moreover, the interaction unit 12 may have an identification unit 18. The identification unit 18 is configured for identifying, or for the identification of, a user of the sink 1. The identification unit 18 may also be formed, for example, by the optical detection unit 16. Additionally or alternatively, however, the identification unit 18 may also have, for example, the acoustic unit 17. As a result, for example, the user may be identified by the evaluation of a speech signal of a user. Additionally or alternatively, the identification unit 18 may be configured as a unit for detecting and evaluating a biometric feature of a user. For example, this may be a fingerprint sensor or a sensor for identifying an iris pattern.

Figure 2:
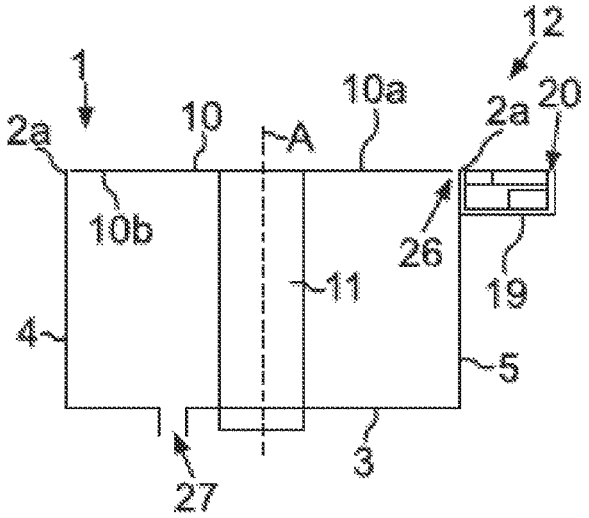
FIG. 2 shows the view of the sink according to FIG. 2 with the insert plate in a second position which is different from FIG. 1.

As may be identified in FIGS. 1 to 3, the interaction unit 12 may be configured at the side and directly adjacent to the basin 2. For example, a receiving housing 19 which is open at the top may be provided here. The receiving housing 19 may be configured separately from the basin 2. However, the receiving housing may also be formed with the basin 2 such that it cannot be released in a non-destructive manner. In particular, the receiving housing 19 may also be configured in one piece with the basin 2. The lateral wall directly adjoining the receiving housing 19, in the example here the lateral wall 5, also forms a defining wall for the receiving volume 20 of the receiving housing 19.

Thus the receiving volume 20 is separated from the receiving area 8 of the basin.

In FIG. 2 the view according to FIG. 1 is shown, but the insert plate 10 is shown in a different position from FIG. 1. In FIG. 2 the insert plate 10 is oriented horizontally but moved upwardly. In particular, this position represents the maximum possible vertical position. In particular, in this position a top 10*a* of the insert plate 10 is flush with an upper edge 2*a* of the basin 2. In particular, in this position, the insert plate 10 forms a cover or a lid for the receiving area 8. This upper edge 2*a*, however, may also be for example a top of a mounting frame or a decorative frame which is a constituent part of the sink 1. The sink 1, in particular the basin 2, may be mounted with the mounting frame in a cutout of a worktop. The basin 2 may be covered from above with a decorative frame. A gap between the basin 2 and a defining wall in the worktop, which defines the cutout, thus may be covered from above. Such a decorative frame, in particular, represents an upper visible component of the arrangement.

In particular, the sink 1 also has a control unit 21 (FIG. 3). The lifting device 11 may be operated by the control unit 21. In particular, the interaction unit 12 may also be operated by the control unit 21.

The sink 1 may preferably also have a faucet 22, as may be identified in the simplified plan view in FIG. 3. The faucet 22 represents a functional unit of the sink 1. The interaction unit 12, in particular the operating device 14, may also be viewed as a functional unit of the sink 1. A further functional unit of the sink 1 may be the insert plate 10. A further functional unit of the sink 1 may be the lifting device 11.

The lifting device 11 preferably has a lifting unit and a motor. As a result, the lifting device may be changed in terms of its length or height in the direction of the vertical axis A. Moreover, the lifting device may be additionally or alternatively rotated about the vertical axis A. As a result, a rotational movement about this vertical axis A is also possible as a position, or as a change in the position, of the insert plate 10. Last but not least, the lifting device 11 may also be set such that the insert plate 10 may be set in an oblique or inclined manner relative to a horizontal plane.

An operating state of the sink 1 may be identified and/or a change in the operating state of the sink 1 may be identified and/or an operation of a user who operates the sink 1, in particular at least one functional unit of the sink 1, may be identified by the interaction unit 12. Depending on the identification by the interaction unit 12, the lifting device 11 is able to be operated for automatically changing the position of the insert plate 10. In FIG. 3 a schematic view of a finger 23 of a user is also shown. The interaction unit 12 is preferably configured for detecting a gesture of the user, in particular of the finger 23. In particular, the gesture is a contactless gesture. Additionally or alternatively, however, a direct operation of the operating device 14 may also be carried out with the finger 23. It is provided that an operating state and/or a change in the operating state may be detected by the camera 16 and/or the acoustic unit 17 and/or the operating device 14. An operating state may be, for example, a setting of the operating device 14 and/or a change in the operating state may be a change in the setting of the operating device 14.

A change in the position of the insert plate 10 may be dependent on the type and/or intensity and/or duration of an operating state of at least one functional unit of the sink 1 and/or a change in the position may be dependent on the type and/or intensity and/or duration of a change in the operating state of at least one such functional unit of the sink 1.

The interaction unit 12 has a normal mode. The actual operation of the sink 1 is also detected in this normal mode. Moreover, the interaction unit 12 has a defining mode which is different from the normal mode. This defining mode may be set, for example, by a user. In this defining mode it is possible that at least one user defines or predetermines at least one reference position of the insert plate 10. In particular, in this defining mode such a reference position may be linked with a specific operating state of at least one functional unit of the sink 1 and/or with a defined change in the operating state of at least one functional unit of the sink 1. At least one such reference position may be stored as a user profile in a memory unit 24 of the interaction unit 12.

In an advantageous embodiment it is provided that the surface shown in FIG. 3 (depth direction z and width direction x) of the top 10*a* is at least 80 percent, in particular at least 90 percent, in particular at least 95 percent, of the surface of the receiving area 8 which is viewed in a horizontal plane (in FIG. 3 the plane of the figures). In particular, however, this surface of the top 10*a* is less than 99 percent of this surface of the receiving area 8 in the aforementioned horizontal plane. As a result, it is achieved that a peripheral edge 25 of the insert plate 10 is spaced apart from the lateral walls 4, 5, 6 and 7. In particular, a peripheral gap 26 between the insert plate 10 and the lateral walls 4 to 7 is formed thereby. The gap 26 may be between 3 mm and 15 mm. Preferably, this gap 26 is sufficiently small, at least in the horizontal position of the insert plate 10, that objects such as cutlery or the like are not able to slip through. Moreover, it is thus possible to avoid the situation where a finger 23 is trapped in this horizontal position of the insert plate 10.

As is also shown in FIGS. 1 to 3, the sink 1 has an outlet opening 27, for example a drain. This outlet opening is configured, in particular, in the base wall 3. It is possible for media to drain out of the receiving area 8 from the basin 2 through this outlet opening 27.

In an advantageous embodiment, the sink 1 may have a residual media discharge device 28. This device is, in particular, a passive residual media discharge device. This also means that the residual media discharge device is configured in a static or immovable manner. In particular, this also means that in an advantageous embodiment it is integrated in the insert plate 10. In particular, it is able to be changed while being permanently bowed.

Residual media on the top 10*a* of the insert plate 10 are preferably discharged by this residual media discharge device 28. For example, it may be provided that the residual media discharge device 28 has at least one hole 29. This hole is configured in the insert plate 10 and is open toward the top 10*a*. A plurality of such holes 29 may also be provided. The hole 29 is a through-hole so that the residual media on the top 10*a* may penetrate through the insert plate 10 and may pass downwardly toward the base wall 3. In this case, in an advantageous embodiment the residual media may be discharged via the outlet opening 27.

Additionally and alternatively, it may be provided that the residual media discharge device 28 has a drainage channel 30. This drainage channel may be oriented, for example, outwardly from the central point of the insert plate 10. Said drainage channel may extend as far as the edge 25. The drainage channel 30 may be open toward the top 10*a* over the entire length. However, it may also be provided that the drainage channel 30 is configured as a drainage duct. In this embodiment, the drainage channel is closed toward the top 10*a*. Only one channel inlet 30*a* is open toward the top 10*a*. A channel outlet 30*b* may be guided toward the edge 25. Additionally or alternatively, a channel outlet 30*b* may be configured to be set back from the edge 25 and may be configured to be open toward the lower face 10*b*.

It may be provided that the top 10*a* is of uneven configuration. A top 10*a* shaped in this manner is a constituent part of the residual media discharge device 28. For example, a slight funnel shape may be formed here. Similarly, however, an upwardly bulged, slightly bowed shape may also be configured so that a slight dome shape is formed. A plurality of such drainage channels 30 may also be provided. These drainage channels may be oriented, for example, in a star-shaped manner.

Additionally or alternatively, a hydrophobic coating 31 may be configured at least in some regions on the top 10*a*.

In a further embodiment, it may be additionally or alternatively provided that the insert plate 10 has a drip rim 32 on the edge 25. This drip rim may be configured, for example, as an undercut or a concave or convex curvature of the edge 25.

Figure 4:
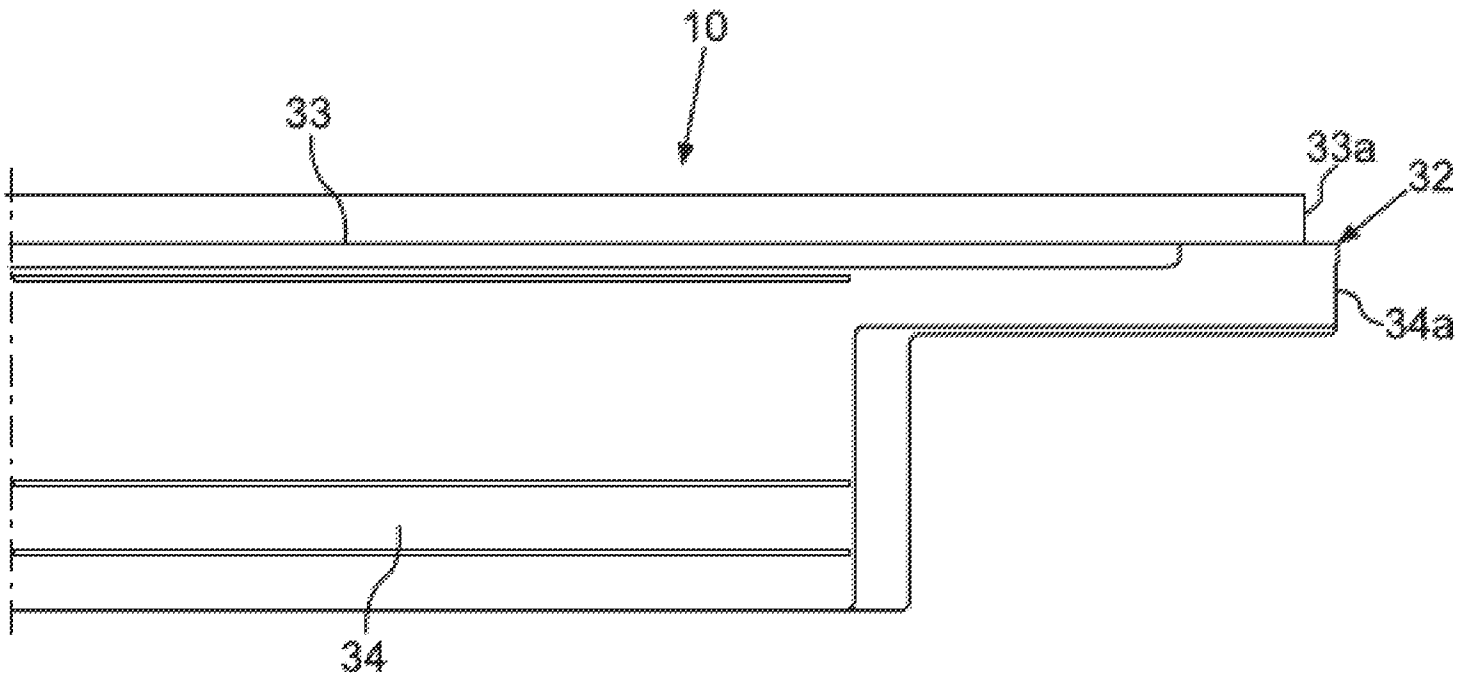
FIG. 4 shows a side view of a partial region of an exemplary embodiment of an insert plate with the integrated residual media discharge device.

In a further embodiment, according to the view in FIG. 4, it may be provided that the insert plate 10 has an upper plate 33 and a lower plate 34 which is separate therefrom. The two plates 33 and 34, however, are connected such that they cannot be released in a non-destructive manner. In particular, it is provided that the upper plate 33 is made from metal, for example from steel. The upper plate may be correspondingly coated, however, on the top, in particular with a hydrophobic coating. In particular, it is provided that the lower plate 34 is configured as made from plastic. In a horizontal plane it is provided that the lower plate 34 projects to the side with a lateral edge 34*a* relative to a lateral edge 33*a* of the upper plate 33. As a result, a specific shape of such a drip rim 32 is formed. In FIG. 4, in this context a stepped transition is formed between the edge 33*a* and the edge 34*a*.

A dismantling mode which is different from the normal mode of the lifting unit of the lifting device 11 may also be set. In this dismantling mode, the lifting unit is set in an even higher position in the height direction above the maximum lifted position of the lifting unit in normal mode and thus also the corresponding position of the insert plate 10. In the maximum lifted position in normal mode, in particular, it is provided that the top 10*a* of the insert plate 10 is flush with the top of the upper edge 2*a* of the basin 2 or a decorative frame or a mounting frame. In the dismantling position, which is higher for this purpose, the insert plate 10 is preferably positioned such that it is arranged with its lower face 10*b* higher than this upper edge 2*a* by a vertical spacing. In particular, this vertical spacing is at least 2 cm, in particular at least 3 cm. As a result, the insert plate 10 may be gripped by a hand on its edge 25 and securely held for removal from the lifting unit. The dismantling position is, in particular, a horizontal position of the insert plate 10. The lower face 10*b* of the insert plate 10 is thus positioned entirely above the upper edge 2*a*.

The invention claimed is:

1. A sink, comprising:

a basin including a base wall and lateral walls adjoining the base wall, said basin including a receiving area delimited by the base wall and the lateral walls;

an insert plate separate from the basin and inserted into the receiving area;

a lifting device configured to move the insert plate relative to the basin; and a residual media discharge device configured to discharge residual media from a top of the insert plate, wherein the residual media discharge device includes a drainage channel in the insert plate, and wherein a part of the drainage channel is closed toward the bottom.

2. The sink of claim 1, wherein the residual media discharge device includes a through-hole configured in the top of the insert plate and passing through the insert plate.

3. The sink of claim 1, wherein the drainage channel is oriented toward an edge of the insert plate.

4. The sink of claim 1, wherein the top of the insert plate has a bowed configuration to form the residual media discharge device.

5. The sink of claim 1, wherein the residual media discharge device includes a hydrophobic coating which is applied at least in one region to the top of the insert plate.

6. The sink of claim 1, wherein the residual media discharge device includes a drip rim on an edge of the insert plate.

7. The sink of claim 6, wherein the insert plate includes an upper plate and a lower plate which is arranged below the upper plate and fixedly connected to the upper plate, wherein when viewed in a horizontal plane the lower plate projects to a side beyond the upper plate.

8. The sink of claim 7, wherein the lower plate projects to the side entirely beyond a periphery of the upper plate.

9. The sink of claim 7, wherein the upper plate is made from metal and/or the lower plate is made from plastic.

10. The sink of claim 7, wherein the upper plate is made from steel.

11. The sink of claim 1, wherein the top of the insert plate has a surface which is at least 80% of a surface of the receiving area in a horizontal plane but less than 99% of the surface of the receiving area.

12. The sink of claim 1, wherein the top of the insert plate has a surface which is at least 90% of a surface of the receiving area in a horizontal plane but less than 99% of the surface of the receiving area.

13. The sink of claim 1, wherein the top of the insert plate has a surface which is at least 95% of a surface of the receiving area in a horizontal plane but less than 99% of the surface of the receiving area.

14. The sink of claim 1, wherein the drainage channel is closed toward the bottom over a length of the drainage channel except for a channel outlet facing toward the base wall of the basin.

15. The sink of claim 1, wherein the drainage channel is closed toward the top of the insert plate over a portion of a length of the drainage channel.

16. The sink of claim 1, wherein the drainage channel is closed toward the top of the insert plate over a length of the drainage channel except for a channel inlet.

17. The sink of claim 16, wherein the drainage channel is closed toward the bottom over the length of the drainage channel except for a channel outlet facing toward the base wall of the basin.

18. The sink of claim 1, wherein the drainage channel is inclined relative to a horizontal plane.

19. The sink of claim 1, wherein the insert plate includes an upper plate and a lower plate which is arranged below the upper plate and fixedly connected to the upper plate, and wherein, when viewed in a horizontal plane, a periphery of the lower plate projects outward in the horizontal plane beyond a periphery of the upper plate.

20. The sink of claim 19, wherein the upper plate includes a first lateral edge at the periphery of the upper plate and the lower plate includes a second lateral edge at the periphery of the lower plate, and wherein the first lateral edge of the upper plate and the second lateral edge of the lower plate form a stepped transition at an edge of the insert plate.

* * * * *